US005531946A

United States Patent [19]

Bold

[11] Patent Number: 5,531,946

[45] Date of Patent: Jul. 2, 1996

[54] PROCESS FOR THE PRODUCTION OF STAFF PANELS ACCORDING TO A SEMIDRY METHOD AND INSTALLATION FOR IMPLEMENTING THE PROCESS

[75] Inventor: Jörg Bold, Kaiserslautern, Germany

[73] Assignee: Babcock BSH Aktiengesellschaft Vormals Buttner-Schilde-Haas AG, Krefeld, Germany

[21] Appl. No.: 204,220

[22] PCT Filed: Sep. 4, 1992

[86] PCT No.: PCT/EP92/02055

§ 371 Date: Mar. 2, 1994

§ 102(e) Date: Mar. 2, 1994

[87] PCT Pub. No.: WO93/04830

PCT Pub. Date: Mar. 18, 1993

[30] Foreign Application Priority Data

Sep. 5, 1991 [DE] Germany ..... 41 29 466.1

[51] Int. Cl.[6] ..... B28B 3/00

[52] U.S. Cl. ..... 264/102; 156/39; 156/44; 156/45; 162/225; 162/398; 162/399; 264/120; 264/122; 264/128; 264/333; 425/71; 425/85; 425/371; 425/446

[58] Field of Search ..... 264/333, 102, 264/101, 87, 120, 256, 211.11, 177.11, 109, 112, 128, 40.3, 116, 40.4, 115, 113, 122; 156/39, 65, 44, 45; 425/71, 84, 85, 371, 145, 308, 202, 445, 446; 162/398, 399, 225

[56] References Cited

U.S. PATENT DOCUMENTS

| | | | |
|---|---|---|---|
| 3,737,265 | 6/1973 | Schafer et al. . | |
| 4,902,348 | 2/1990 | Kossatz et al. | 264/333 X |
| 4,942,003 | 7/1990 | Bold . | |
| 5,051,221 | 9/1991 | Bold . | |
| 5,135,693 | 8/1992 | Hilbert et al. . | |
| 5,160,411 | 11/1992 | Bold . | |
| 5,342,566 | 8/1994 | Schäfer et al. | 264/333 X |
| 5,368,663 | 11/1994 | Bold . | |

FOREIGN PATENT DOCUMENTS

| | | |
|---|---|---|
| 0153588 | 9/1985 | European Pat. Off. . |
| 0415184A2 | 3/1991 | European Pat. Off. . |
| 1784657 | 8/1971 | Germany . |
| 2103931 | 8/1972 | Germany . |
| 2751466A1 | 5/1979 | Germany . |
| 2751473C3 | 5/1979 | Germany . |
| 2751466B2 | 7/1980 | Germany . |
| 3801315A1 | 7/1989 | Germany . |
| 3906009C1 | 9/1990 | Germany . |
| 4009883A1 | 10/1991 | Germany . |
| 4025797A1 | 4/1992 | Germany . |
| 4129466A1 | 3/1993 | Germany . |
| 239713 | 2/1946 | Switzerland . |
| 1258288 | 12/1971 | United Kingdom . |

*Primary Examiner*—Karen Aftergut
*Attorney, Agent, or Firm*—Herbert Dubno

[57] ABSTRACT

Production of plasterboard includes spreading of a mixture formed of gypsum, fibers and water onto a continuously moving belt to form a spread layer subsequently precompressed to 110% to 180% of a final board thickness and successively wetted from both sides and thereafter compressing the wetted layer to the final board thickness.

15 Claims, 4 Drawing Sheets

PROCESS FOR THE PRODUCTION OF STAFF PANELS ACCORDING TO A SEMIDRY METHOD AND INSTALLATION FOR IMPLEMENTING THE PROCESS

CROSS REFERENCE TO RELATED APPLICATIONS

This application is a national phase of PCT/EP 92/02055 filed Sep. 4, 1992 and based, in turn, on German national application P41 29 466.1 of Sep. 5, 1991 under the International Convention.

This application is copending with Ser. No. 07/972,493 which has since issued as U.S. Pat. No. 5,368,663 based upon PCT/EP91/01359 filed Jul. 19, 1991.

FIELD OF THE INVENTION

The present invention relates to a process and an installation for producing plasterboard.

BACKGROUND OF THE INVENTION

In order to produce staff panels according to a dispersion method, a mixture of binding agents, reinforcement materials and optionally fillers is spread, mostly in several layers, upon a forming belt which moves continuously underneath dispersion devices and is subsequently compressed in a press. As binders gypsum or gypsum mixtures are used, e.g. hemihydrate, dihydrate, cement and additives, such as setting accelerants and/or retardants. As reinforcement materials, fibers, e.g. of waste paper, and as fillers e.g. perlite are used. The additives can first be mixed with the water and then added with the water to the plaster mixture.

During these process steps the gypsum has to be supplied with the water required for setting. It has been found that this is one of the most difficult tasks of the entire process.

In a process known from DE 27 51 466 and DE 27 51 473 the mixture is spread in a dry state and sprayed with water from above upstream of the press, whereby the water absorption is assisted by the vacuum applied under the permeable support belt. The dispersed layer can then absorb an excess of water, which is squeezed out in the press.

The disadvantages of this procedure include the need for a dewatering press. The resulting squeezed out water contains gypsum and there is a high residual wetness of the pressed plate which has to be dried.

By contrast in a so-called semidry process known from EP 0 153 588 only so much water is supplied as can be absorbed by the dry mass of gypsum, fibers and optional fillers, i.e. only so much water that during the pressing of the layer no water is squeezed out.

As is known from EP 0 153 588, the water is supplied in two fractions. The first fraction of water is supplied during the preparation of the spreadable mixture with a dry mix of gypsum and fibers. The second fraction of water is sprayed onto the individual layers, immediately after the spreading of the layer. Subsequently the wetted layer is compressed in a preliminary press and then compressed to its final density in a main press.

In order to improve this process it is known from DE 38 01 315 to let an upper screen belt run along in the presses during compression, for the purpose of venting. Further it is known from DE 39 06 009 to introduce the first water fraction with wetted and ground paper fibers. This way a mixer for the preparation of the dry mix can be eliminated.

The spreadable mix is thereby produced by mixing the gypsum and the fibers provided with the first water fraction.

However in this process a considerable amount of water, the second water fraction, has to be sprayed. The spraying of spread layer or layers has a few disadvantages.

The loose, spread material can not absorb the water well enough. As a result in the upper areas there is excess water and corresponding lower areas with less water, which means that the wetting achieved by this spraying is uneven. The wetting evens out only during compression in the presses.

Since a water excess has an accelerating effect on the setting of the gypsum, the uneven wetting leads to different setting speeds in the spread, wetted layer.

There is also the danger that especially the bottom side of the first layer may receive too little water for the complete setting of the gypsum.

A further disadvantage is that devices for the spraying of the layers are arranged between the dispersion devices. In addition to the disadvantageous space requirements of the spraying devices, this arrangement requires that the various strata of the layer traverse different stretches until they reach the presses, thereby being wetted at different times. This results in differences in the onset of the setting process of the gypsum in the various strata.

Just like the different setting speeds due to uneven wetting in a layer, the different onset times of the setting in the various strata lead to weak areas in the finished plate caused by uneven setting. The control of the production process is made more difficult, especially since there is no possibility to monitor the setting process in the dispersed, wetted layer and to correct it.

DE-OS 40 25 797 describes a process wherein a portion of the second fraction of the water is supplied after compression by preliminary and main presses. The water is first applied by spraying to the bottom side of the plate and subsequently to its top side.

Subsequently the after-wetted plate is additionally compressed with a pressure which is not higher than that of the main press. In this case an additional press is needed. Besides only a small portion of the second water fraction can be supplied to a compressed plate during the additional wetting. A spraying of the spread material with the possibility of uneven wetting remains.

OBJECTS OF THE INVENTION

It is the principal object of the present invention to provide an improved process for making plasterboard in which a more uniform wetting of the plasterboard layer is achieved at low cost.

Another object is to provide an improved apparatus for making plasterboard by carrying out the improved method.

SUMMARY OF THE INVENTION

These objects are achieved in its method aspect by the steps of:

(a) forming a mixture of gypsum, fibers and water in an amount less than necessary for hardening of the gypsum;

(b) spreading the mixture onto a continuously moving belt to form a spread layer;

(c) precompressing the layer to 110% to 180% of a final board thickness;

(d) at least upon precompression successively wetting the layer from both sides; and (e) thereafter compressing the wetted layer to the final board thickness.

According to the apparatus aspects of the invention, the apparatus can comprise:

means for mixing gypsum, fibers and water in an amount less than required for hardening of the gypsum to form a mixture;

at least one forming belt;

means juxtaposed with the belt and receiving the mixture for spreading the mixture in at least one layer on the belt;

means forming a preliminary press along the belt downstream of the means for spreading, for compressing the belt to 110 to 180% of a final thickness of the plasterboard;

means downstream of the means for spreading for successively applying water to upper and lower parts of a layer of the mixture precompressed on the belt and including upper and lower wetting devices;

a main press downstream of the preliminary press along the belt for pressing the layer after wetting of upper and lower parts thereof to a final plasterboard thickness;

an upper screen belt guided through the preliminary press and the lower wetting device;

a lower screen belt above the forming belt, the forming belt being returned downstream of the preliminary press and the lower screen belt extending at least through the lower wetting device.

In a process according to the invention the spread layer is subjected to a preliminary compression to 110 to 180% of the plate thickness, i.e. the finished size of the plate, prior to wetting with the second fraction of water. During the preliminary compression or immediately after that both sides of the layer are successively wetted. Only after the wetting with the entire second fraction of water is the precompressed plate further compressed to plate thickness.

Due to the preliminary compression to 110 to 180% of final thickness a layer is created which can absorb water considerably better than the spread layer, but also better than the layer already compressed to plate thickness. A particularly even wetting over the entire layer height is achieved upon a preliminary compression to 110 to 150% of final plate thickness.

Particularly wet or dry areas in the dispersed layer and thereby areas wherein the setting of the gypsum is accelerated by water excess or delayed by too little water, are avoided.

Since, in addition, the wetting of both sides of the layer takes place in immediate succession, i.e. the setting in the board starts approximately at the same time, with the process of the invention a considerably more uniform setting is achieved. This leads to an improved plate quality, especially to higher strength.

In the process of the invention it is no longer necessary to spray the individual strata directly after spreading. The wetting devices, which here are arranged in or immediately downstream of the preliminary press for preliminary compression, are no longer contaminated by whirled-up loose material.

In addition wetting devices between the dispersion devices and the additional press become superfluous. With the process of the invention it is possible to obtain a plate of improved quality at lower cost.

According to a feature of the invention, the initial member contains water in an amount of 15 to 27%, preferably 18 to 24% of the dry mass and, during the subsequent wetting, water in an amount of 10 to 30%, preferably 15 to 25% of the dry mass is supplied, whereby the total water amounts to 35 to 45% of the dry mass.

Thus a total water amount of 35 to 45% of the dry mass can be supplied. This total water amount which is approximately 2 to 3 times the stoichiometric water amount required for the setting of the gypsum, makes possible a more even wetting of the precompressed layer, without squeezing out of water during the compression to final plate thickness.

Since fibers and optional fillers also absorb water, more than the stoichiometric water amount is required in order to insure a complete setting of the gypsum. A mixture to be spread containing water in an amount of 15 to 27% in relation to the dry mass contains on the one hand a high proportion of the total amount of water to be supplied, while on the other hand it still has good spreadability. A larger amount of water would lead to granulation or lump formation in the mixture. Mixtures with a water amount of 18 to 24% in relation to the dry mass are particularly suitable, i.e. have particularly good spreadability.

Advantageously, during preliminary compression the top side of the layer is wetted and after the preliminary compression the bottom side is wetted. The wetting during the preliminary compression leads to a particularly good water absorption of the layer. The water absorption can be further improved by alternating preliminary compression and wetting, e.g. with the assistance of a roller press and of wetting devices arranged between the press cylinders. Thereby the spring-back of the layer after compression and during wetting causes a suction effect which assists the water absorption of the layer.

In a further process variant the wetting of one or both sides of the layer is done by spraying. It is possible to regulate the supplied water amount by differential measurements of the supplied and captured runoff water amounts, which results in a precise dosage of the supplied water amounts. This is of particular advantage in the spraying of the bottom side of the layer, since from the bottom side the water can easily drip off.

The bottom side of the layer can also be wetted by guiding the precompressed layer through a water bath. The precompressed layer is guided through the water bath so that only the bottom side of the layer is wetted. For this purpose it is necessary for instance to prevent that the water penetrates the layer at the two edges of the layer and flows onto the surface of the layer, by means of a screen belt with elevated borders which are not water permeable. The water bath is supplied with the dosed amount for wetting the bottom side of the layer.

The invention takes advantage of a self-regulating mechanism of water absorption of the layer. The layer is guided at a small angle into the water bath and back again. Its water absorption increases steadily with the wetted surface and with the height of the water level.

If a dosed amount of water is supplied to the water bath, a water level is set wherein the supply and the absorption by the layer are balanced. The layer always absorbs the supplied amount of water, independently of the way this water absorption takes place in detail.

Due to the fact that thicker parts of the layer are exposed to the water for a longer time and therefore absorb more water, the material is evenly wetted even when the thickness of the layer varies slightly.

When underpressure (subatmospheric pressure or suction) or overpressure (superatmospheric pressure) is applied in at least one zone of the top side of the layer, the even wetting of the layer from underneath is improved. Preferably in a first zone underpressure is applied in order to remove the air from the pores of the layer and the screen belts. If there are several zones, it is preferred to subsequently apply overpressure and underpressure in an alternating manner.

According to the invention, the preliminary press has upper and lower pressure rollers arranged at a distance from one another and the upper wetting device has spray nozzles between the upper pressure rollers.

The additional shaping of the bottom side of the boxes or trays or the arrangement of the guide rollers so that they create a concave gliding surface in the travel direction makes possible a good guidance of the layer through the vat.

A large depth of the trays (a multiple of the board thickness) and guidance mechanisms for this depth prevent turbulence in the vat which could be produced by the layer traversing the vat.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
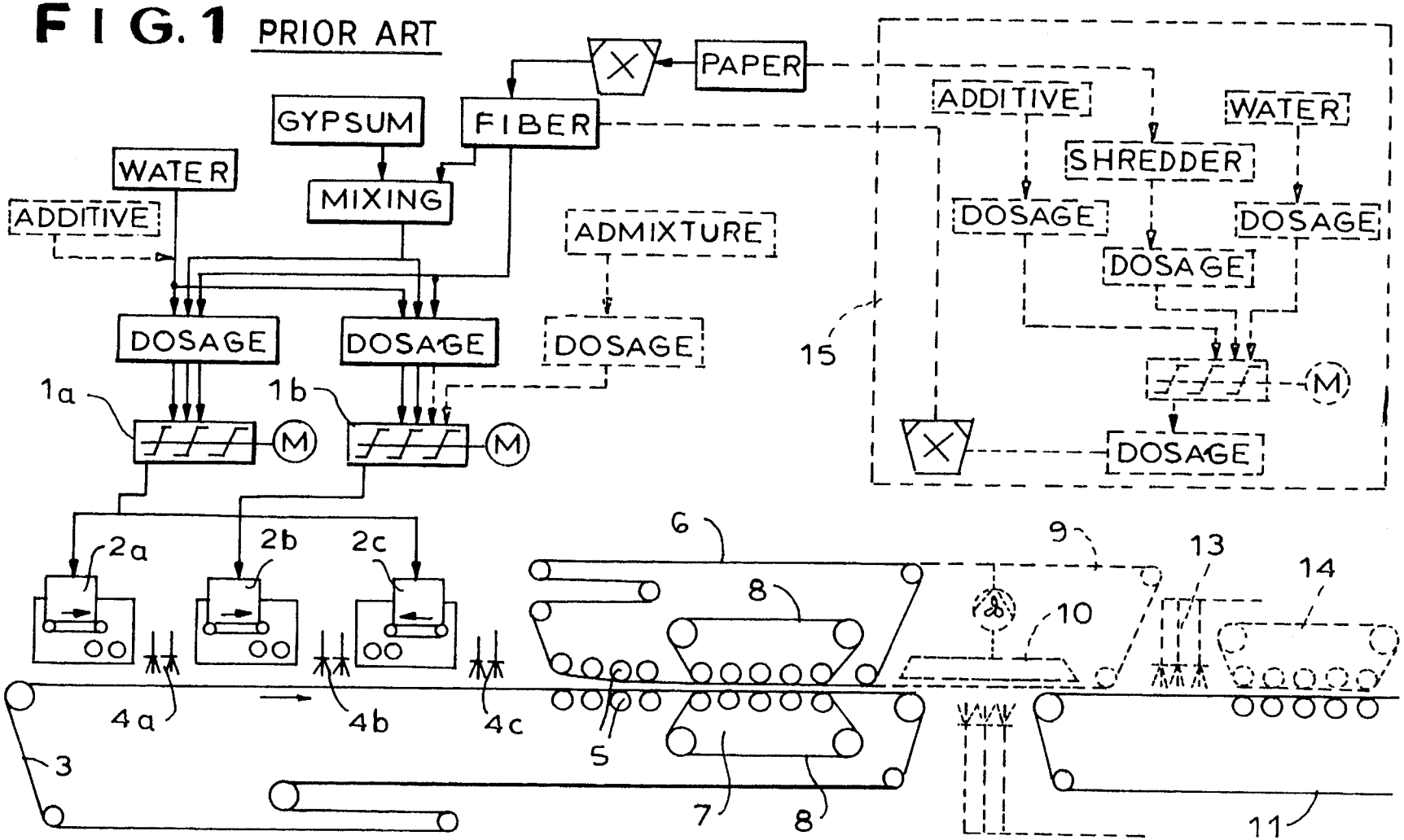
FIG. 1 PRIOR ART
FIG. 1 is a flow diagram showing an installation according to the state of the art.

A known installation for the production of staff panels according to a semidry process has storage facilities for water, optionally additives, gypsum, fibers and optionally fillers. The storage facility for fibers has a conveyor coming from the paper container via a shredding device. Supply lines from the storage facility for fiber and for gypsum end in a dry mixer.

The installation has two mixers 1*a*, 1*b*, fed by a supply line from the storage facility for water and the dry mixer, via a dosage device. Optionally a further supply line leads from the storage facility for fillers via a dosage device to the second mixer 1*b*. The mixers 1*a*, 1*b* for instance can be continuous horizontal mixers with mixing rotors or rotary kiln mixers.

Further the installation has three spreading devices 2*a*, 2*b*, 2*c* which are arranged above a forming belt 3, one after the other in its travel direction. The outlet of the first mixer 1*a* is connected via conveyor belts with the first and third spreading devices 2*a*, 2*c*, and the outlet of the second mixer 1*b* is connected via a conveyor belt to the second spreading device 2*b*. Downstream of the first spreading device 2*a* and upstream of the second spreading device 2*b*, there is a spraying device 4*a* with nozzles directed towards the forming belt 3.

A further spraying device 4*b* is located between the second and third spreading devices 2*b*, 2*c* and a third spraying device 4*c* downstream of the spreader 2*c*.

Downstream of the third spraying device 4*c* a preliminary press 5, e.g. a roller press, is provided. The forming belt 3 is guided over the lower rollers and a screen belt 6 is guided over the upper rollers of the preliminary press 5. The forming belt 3 and the screen belt 6 are both also guided through a main press 7, also a roller press, which is arranged downstream of the preliminary press 5. The main press 7 has additional steel belts 8 guided within the forming belt 3 and within the screen belt 6.

The screen belt 6 extends over a vacuum box 10 connected with a blower 9 and arranged downstream of the main press 7 at the level of the upper rollers and is guided in reverse downstream of the box. The forming belt 3 projects under the vacuum box 10 and is guided in reverse in its first quarter. It is an endless plastic belt.

In the last quarter of the vacuum box 10 a further lower belt 11 starts, so that underneath the vacuum box 10, between the forming belt 3 and the lower belt 11 there is a free stretch. On this stretch a lower spraying device 12 with nozzles for spraying the bottom side of the layer is arranged.

An upper spraying device 13 with nozzles is located immediately after the return point of the screen belt 6, above the lower belt 11.

The lower belt 11 is guided through an additional press 14, i.e. a roller press with an upper belt succeeding the upper additional wetting device 13, and through further devices e.g. for drying the plate (not shown).

FIG. 1 also shows a paper treatment device 15, which besides storage facilities for additives, paper and water, has a mixer to which lead supply lines from the storage facilities via dosage devices.

In the supply line coming to the mixer from the storage facility for paper, between the storage facility and the dosage device, a preliminary shredder is arranged. The outlet of the mixer is optionally connected with the storage facility for fibers via a dosage device and a milling device. When the paper treatment device 15 is provided, the storage facilities for water and the dry mixer are no longer necessary.

In operation a mixture of gypsum, fibers and the first fraction of the water is spread by the devices 2*a*, 2*b*, 2*c* in three layers onto the continuously moving forming belt 3. Each layer is wetted directly after spreading by the spraying devices 4*a*, 4*b*, 4*c* with a portion of the second water fraction.

The mixer 1*a* feeds the first and third dispersion devices 2*a* and 2*c*, which produce the bottom and top layers, i.e. the outer parts of the spread material. In addition the second mixer 1*b* which feeds the second dispersion device 2*b* can be supplied with fillers. This way it is possible to select a different composition for the intermediate strata of the dispersed layer.

The dispersed and wetted layer is compressed to a final thickness first in the preliminary press 5 and subsequently in the main press 7. After that the resulting plate is additionally sprayed in succession from below and from above with the balance of the second water fraction. During the additional wetting from underneath, the plate is held by the vacuum box 10. The additionally wetted plate is recompressed in the additional press 14.

When the paper treatment device 15 is used, the paper is preshredded and mixed with the first water fraction, i.e. up to 200% per dry mass of papers, and optionally with additives. After a certain dwelling time the prewetted paper is milled to fibers in the milling device and conveyed to the storage facility for fibers.

In the two mixers 1*a*, 1*b* the wetted fibers are mixed with gypsum and the mixture is then supplied to the dispersion devices 2*a*, 2*b*, 2*c*.

DESCRIPTION OF THE INVENTION

EXAMPLE 1

Figure 2:
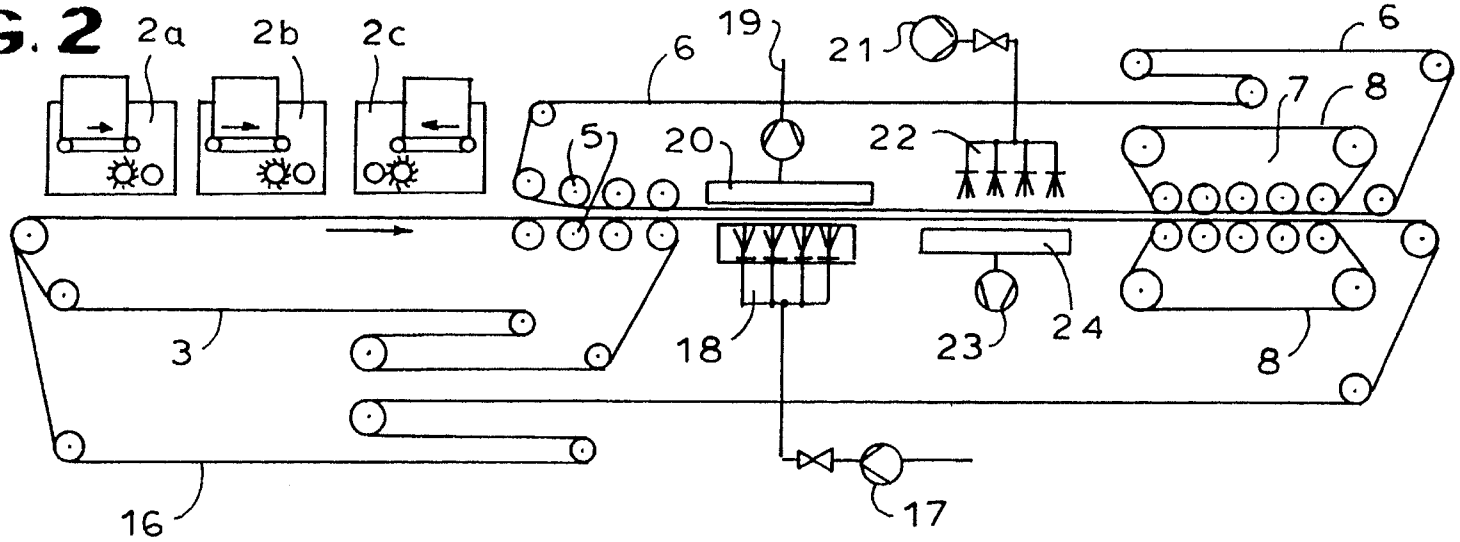
FIGS. 2, 3, and 4 are diagrammatic side elevational views of the apparatus for carrying out Examples 1, 2, 3 and 4 of the invention.

An installation according to the invention (FIG. 2) distinguishes itself over the state of the art due to the following features. It has an additional lower screen belt 16. The lower screen belt 16 is located underneath the spreading devices 2*a*, 2*b*, 2*c* arranged immediately one after the other and in the preliminary press 5 on the forming belt 3, which is returned downstream of the preliminary press 5. The forming belt 3 can thereby be replaced by a sliding table. The lower screen belt 16 extends all the way through the main press 7 where it is located on the lower steel belt 8.

The preliminary press 5 and the main press 7 are arranged at a distance from each other.

Downstream of the preliminary press 5 and upstream of the main press 7, under the screen belt 16 a lower spraying device 18 provided with a dosage device 17 is arranged. Above the upper screen belt 6 running through the preliminary press 5 and the main press 7, opposite to the lower spraying device 18, there is a vacuum box 20 connected to a blower 19. Downstream thereof, also before the main press 7, above the upper screen belt 6, an upper spraying device 22 also provided with a dosage device 21 is arranged. Underneath the lower screen belt 16, opposite the upper spraying device 22, there is a further vacuum box 24 connected with a blower 23.

By contrast to an installation of the state of the art as in FIG. 1, the installation of the invention has no spraying devices 4*a*, 4*b*, 4*c* between the dispersion devices 2*a*, 2*b*, 2*c* and no additional press 14.

In operation in an installation with a production width of 2,500 mm and a belt speed of 15 m/min the following amounts are dosed into the dry mixer:

| | |
|---|---|
| Gypsum hemihydrate (plaster of Paris) | 20,500 kg/h |
| Gypsum dihydrate (milled) | 100 kg/h |
| Paper fiber (dry) | 4,200 kg.h |

Each of the mixers 1*a*, 1*b* are supplied with 50% of the dry mass of 24,800 kg/h. In addition 2,580 l/h of water, i.e. 20.8% of the dry mass are supplied to the first mixer 1*a*, and to the second mixer 1*a* 2,880 l/h water, i.e. 23.2% of the dry mass are introduced, with the proportions of retardants and accelerants adjusted to the gypsum.

The mixture is spread on the forming belt 3 in three strata. The dispersed layer has a height of approximately 50 mm and is precompressed in the preliminary press 5 to a height of approximately 12 mm, i.e. to approximately 120% of the plate thickness. It springs back to approximately 16 mm. After that with the spraying devices 18, 22 the layer is sprayed first from underneath and subsequently from above each time with 2,280 l/h of water, i.e. a total of 18% of the dry mass. During spraying the supplied water amount is adjusted based on differential measurements of the supplied and discharged water amounts. A total water amount representing approximately 40% of the dry mass, i.e. approximately three times the stoichiometric water amount, is supplied.

During spraying air is evacuated from the layer and from the screen belts 16, 6, by the vacuum boxes 20, 24 [sic] arranged opposite to the spraying devices 18, 22.

In the main press 7 the layer is compressed to a plate thickness of 10.3 mm. After setting the raw plate still contains 14.2% residual wetness. After drying a plate is obtained with a density of 1,150 kg/m3 and a bending resistance of 8.0N/mm.

EXAMPLE 2

Figure 3:
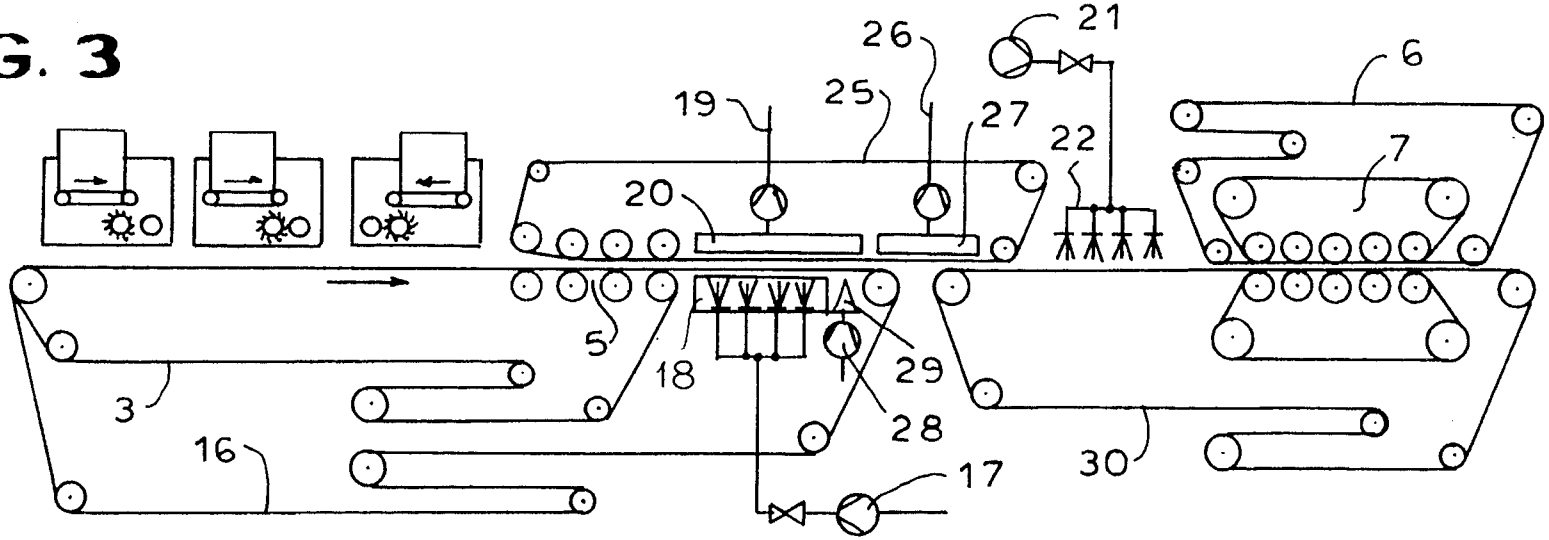

In the installation of Example 2 (FIG. 3), the upper screen belt 6 is guided only through the main press 7. A second upper screen belt 25 extends through the preliminary press 5, along the vacuum box 20 opposite the lower spraying device 18 and along a further transfer vacuum box 27 connected with a blower 26. Downstream of the transfer vacuum box 27 the upper screen belt 25 reverses its path. The upper spraying device 22 is arranged between the return point of the upper screen belt 25 and the main press 7.

The lower screen belt 16 runs through the preliminary press 5, along the lower spraying device 18 and over one or more relief nozzles 29 connected with a blower.

The relief nozzles 29 are arranged at the end of vacuum box 20 [sic]. The lower screen belt 16 projects up to the front edge—considered in travel direction—of the transfer vacuum box 27 and is returned from there.

A further smooth, lower belt 30 starts at the rear edge of the transfer vacuum box 27, extends underneath the upper spraying device 22 and is guided through the main press 7. There is no vacuum box arranged correspondingly opposite the upper spraying device 22.

In operation the layer precompressed in the preliminary press 5 is first wetted on its bottom side by the spraying device 18. Subsequently the layer is detached from the lower screen belt 16 by blowing air through the detaching nozzles 29 and transferred to the smooth lower belt 30 with the assistance of the transfer vacuum box 27. There the layer is wetted on its top side by the spraying device 22 and compressed to final plate thickness in the main press 7. Thereby the bottom side of the plate is smoothed by the smooth, lower belt 30.

EXAMPLE 3

The installation of the Example 3 (FIG. 4) differs from that of Example 2 in that the lower screen belt 16, as in Example 1, is guided all the way through the main press 7. Correspondingly a vacuum box 24 with blower 23 is arranged opposite to the upper spraying device 22 located directly upstream of the main press 7.

The installation of Example 3 differs from the one in Example 2 also in its lower wetting device. The lower wetting device has a tray or trough 32 provided with a dosage device 31. Outer rollers 33 are arranged above each the front and rear edges of the tray 32 considered in travel direction. Between the outer guide rollers 33 extends a box divided in two in the direction of travel with venting holes on its bottom side, on whose front half a suction blower 35 and on whose rear half a pressure blower 36 are connected. The bottom side of the box 34 projecting into the tray 32 is designed as a sliding surface, concavely curved in the travel direction. The curvature corresponds approximately to a radius of 5 to 15 m. Thereby it is important that the outer guide rollers 33 and the box 34 be arranged so that screen belts 16, 25 are guided downwards and back again at a small angle.

The upper screen belt 25 is returned downstream of tray 32. At this point the lower screen belt 16 is guided over a further roller 37.

In operation the layer precompressed in the preliminary press 5 is guided through tray 32 so that only the bottom side of the layer is wetted. From the top side next in a first zone air is evacuated from the layer and the screen belts 16, 25 and subsequently in a second zone an overpressure is applied to the upper side of the layer. The respective pressures are adjustable.

In the tray 32 a precisely metered water amount is introduced, which is absorbed by the layer. Subsequently the top side of the layer is wetted by spraying devices 22 and finally the layer is compressed in the main press 7 to plate thickness.

EXAMPLE 4

In the installation of Example 4 (FIG. 5) the upper screen belt 6 and the lower screen belt 16 are guided through the preliminary press 5, wherein the upper spraying device 22 is arranged, the lower wetting device and the main press 7. Thereby upper and lower pressure rollers 38 of the preliminary press 5 are arranged at a distance from each other. Between the upper pressure rollers 38 there are nozzles 39 of the upper spraying device 22.

The lower wetting device consists of tray 32 provided with a dosage device 31 as described in Example 3. Between the outer guide rollers 33 arranged above the edges of tray 32, suction/pressure boxes 40 and further guide rollers 41 are alternately arranged in succession. The boxes 40, four in this example, are connected via ducts 42 with the suction blower 35 and the pressure blower 36. In the ducts 42 there are valves 43, so that the blowers 35, 36 can be connected selectively with the boxes 40. The air pressure is adjustable.

As in Example 3, the guide rollers 41 form a sliding surface concavely curved in the travel direction, along which the upper and the lower screen belts 25, 16 are guided through the tray 32. The dipping depth of the lower screen belt 16 is of the order of magnitude of the layer thickness.

The extent of tray 32 in the travel direction corresponds approximately to that of the main press 7, e.g. 3 to 5 m. It is wider than the layer on both sides by approximately 25 cm. Its depth is about 10 times the plate thickness.

Figure 7:
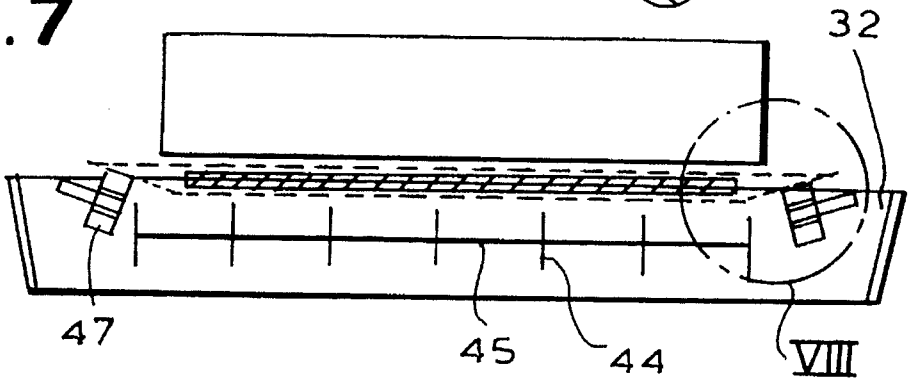
FIG. 7 is an enlarged detail of a portion of the tray of FIG. 6.

Underneath the lower screen belt 16 on the tray 32, there are guiding devices 44, 45 extending in the travel direction, with vertical and horizontal guide surfaces as is illustrated in FIG. 7.

Figure 4:
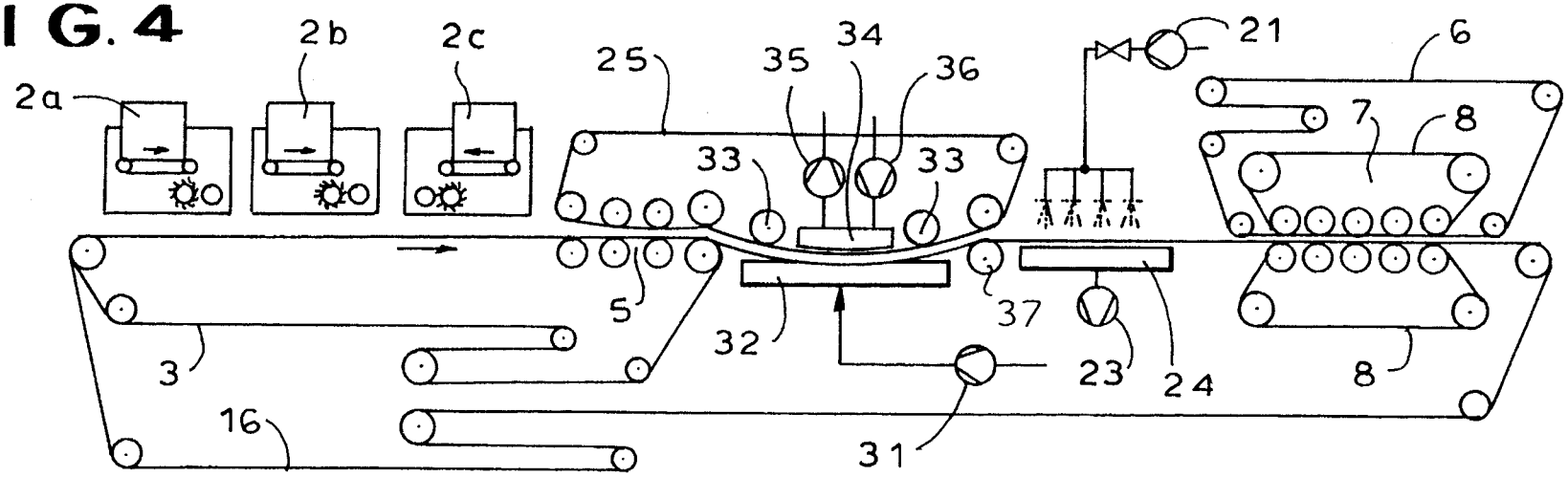
Figure 6:
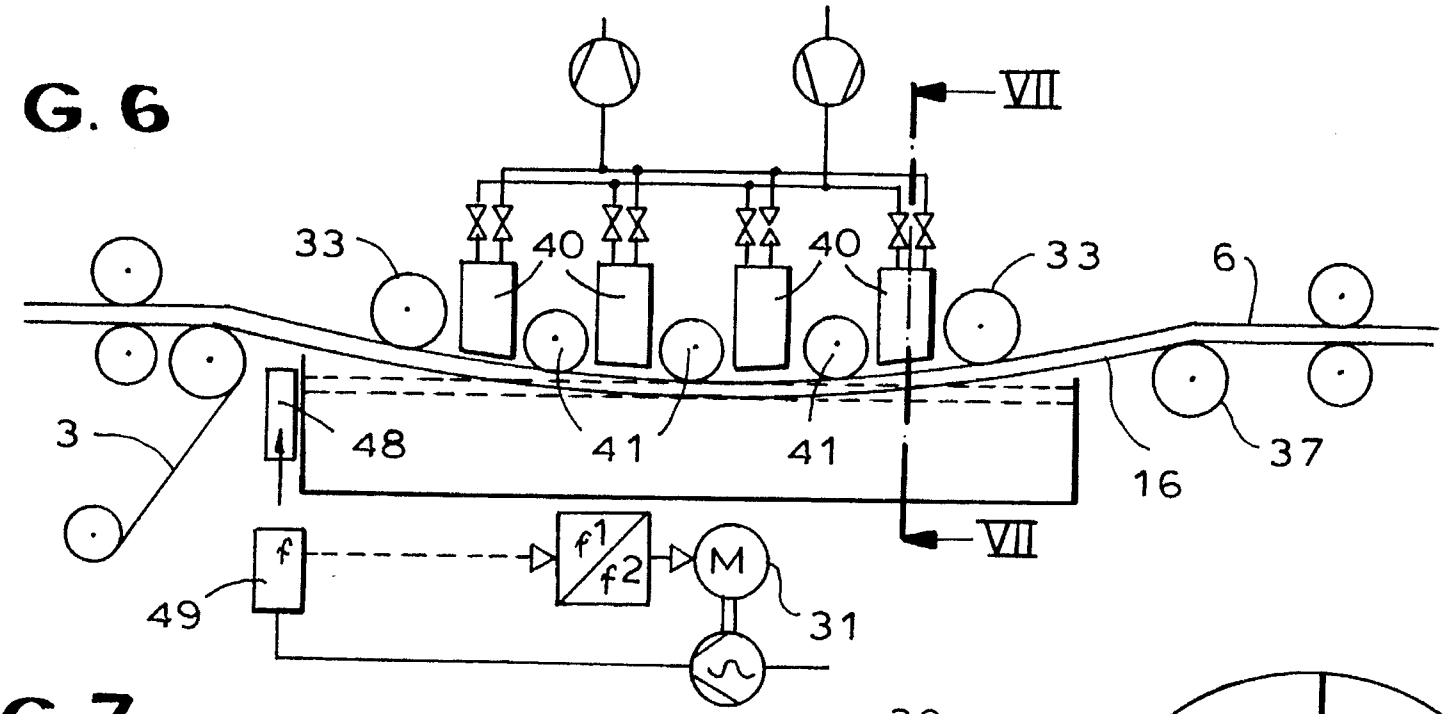
FIG. 6 is a detail vertical section of the tray.
Figure 8:
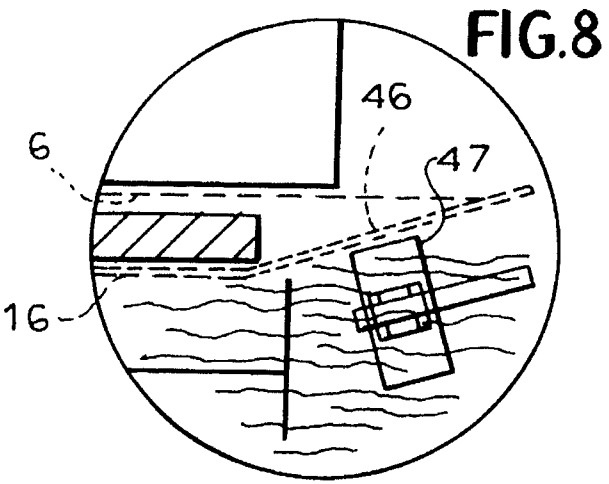
FIG. 8 is a section along line IX—IX of FIG. 6.

The lower screen belt 16 is wider than the upper screen belt 6 (respectively upper screen belt 25, (FIG. 4). Its lateral edges are sealed with elastic plastic material 46 as is clearly shown in FIG. 8. The cover projects on both sides by about 5 cm into the area of the precompressed layer as is illustrated in a greater detail in FIG. 8. Besides in the tray 32 the lower screen belt 16 is guided by its edges over rollers 47. The rollers 47 are arranged so that the edges of the lower screen belt 16 are bent upwards. As is shown in a greater detail in FIG. 6 tray 32 is provided with an inlet 48 at its front end. The inlet 48 is designed in the manner of a diffuser with an overflow (not shown), extending over the entire width of the vat. FIG. 6 illustrates the dosage pump 31 generates a flow and 31 is connected to the inlet 48 via a flow meter 49.

In operation the dispersed layer is alternately compressed in the preliminary press 5 by pressure rollers 38 (FIG. 5) and sprayed in the area between the pressure rollers 38. Thereby the spring-back of the layer when it is no longer subjected to the load of the pressure rollers 38 results in an enhanced suction of the water in the layer.

Subsequently the precompressed layer arranged between the belts 16 seen in FIGS. 2–5, 25 is guided through a water bath, namely through the vat 32 supplied with a metered amount of water, so that only the bottom side of the layer is wetted. This is insured by the upturned edges of the lower screen belt 16 which are sealed with the plastic material 46. The layer is guided into the water bath and then back at a small angle, e.g. of 1 to 10 degrees seen in FIG. 7 which is a front view of the trays illustrated in FIGS. 5 and 6 and is particularly well illustrated in FIG. 8 which shows the guide roller 47 in a greater detail. Due to the described self-regulating mechanism it absorbs exactly the apportioned amount of water.

Figure 5:
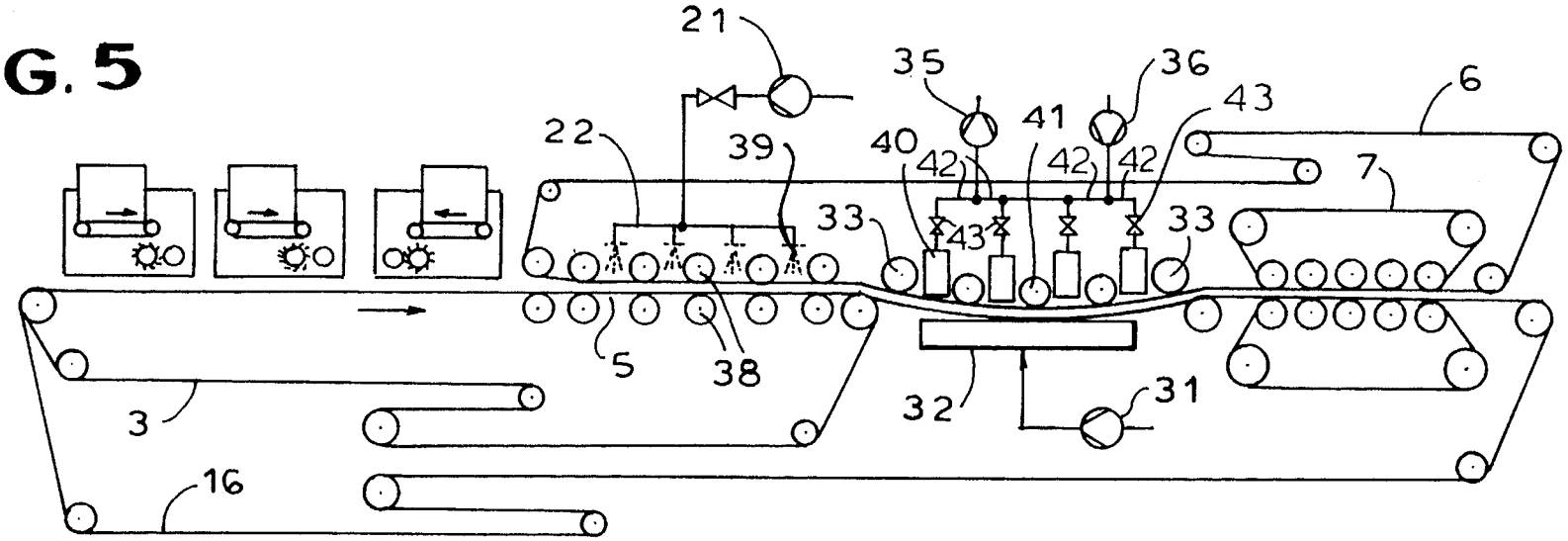
FIG. 5 is a view similar to FIG. 4 but which shows a tray for wetting the bottom side of the layer of Example 4.

In this example the layer is alternately loaded and relieved by the guide rollers 38, 41 (FIGS. 5 and 6).

The spring-back of the layer between the guide rollers 38, 41, enhances the wetting of the layer through aspiration of water as in the upper spraying device 22 of this example. This spring-back of the layer during wetting can also be achieved by guiding the layer in the water bath along a curved surface, whose radius increases constantly.

By means of the suction/pressure boxes 40 (FIGS. 5 and 6) between the guide rollers 41 the air is evacuated from the layer in a first zone, in order to remove the air from the layer and most of all from the lower screen belt 16. Then in a second zone at the rear box a certain air pressure from above is applied to the layer guided through the water bath. This applied air pressure counters the effect of uneven wetting of areas with variable density of the layer. The boxes 40 can also be operated in such a way that through the boxes 40 alternately in one zone air can be aspired by one box 40, and by the next one in the following zone air can be applied, whereby in the first box 40, i.e. in the first zone, air is always aspired.

In an installation with a production width of 2,500 mm and a belt speed of 15 m/min the following dosed amounts are supplied to each of the mixers 1*a* and 1*b*:

| | |
|---|---|
| Gypsum hemihydrate (plaster of Paris; 5.9% H2O) | 10,500 kg/h |
| Gypsum dihydrate (milled) | 50 kg/h |
| Paper fibers (dry weight) | 2,000 kg/h |
| Water (contained in paper fibers) | 2,800 kg/h |

The paper fibers saturated with water are prepared in the paper treatment device 15. The 30,700 kg/h of mixture of gypsum, fiber and water, whereby the water amount represents approximately 22% of the dry mass, is spread in three strata. The dispersion height is about 45 mm. The layer is precompressed in the preliminary press 5 to a thickness of 11.5 mm, i.e. approximately 112% of the plate thickness. It springs back to 15 mm. During precompression 2,400 l/h water are sprayed from above. In the vat the layer absorb from underneath also 2,400 l/h water.

Therefore during wetting a water amount representing 19% of the dry mass is supplied. This way the total amount of water supplied represents approximately 41% of the dry mass and approximately three times the stoichiometric water amount.

In the main press 7 the layer is compressed to a plate thickness of 10.3 mm. After setting the raw plate still contains 14.2% residual wetness. After drying a plate with a density of 1,170 kg/m3 and a bending resistance of 9.2N/mm is obtained.

I claim:

1. A process for producing plasterboard which comprises the steps of:

(a) forming a mixture of gypsum, fibers and water in an amount less than necessary for hardening;

(b) spreading said mixture onto a continuously moving belt to form a spread layer;

(c) precompressing said layer to 110% to 180% of a final plasterboard thickness;

(d) at least upon precompression successively wetting said layer from a top side and a bottom side; and (e) thereafter compressing the wetted layer to said final plasterboard thickness.

2. The process defined in claim 1 wherein said layer is precompressed to 110% to 150% of the final plaster board thickness in step (c).

3. The process defined in claim 2 wherein said mixture is formed in step (a) as an amount of water equal to 15 to 27% of the dry mass of said mixture, and wherein in step (d) an amount of water equal to 10 to 30% of said dry mass is supplied whereby the total amount of water in said layer upon compression to said final thickness in step (e) is equal to 35 to 45% of the dry mass.

4. The process defined in claim 3 wherein in step (a) water is present in said mixture in an amount of 18 to 24% of said dry mass thereof and in step (d) water is added in an amount of 15 to 25% of said dry mass to said layer.

5. The process defined in claim 4 wherein in step (d) said top side of said layer is wetted during precompression and said bottom side of said layer is wetted after precompression.

6. The process defined in claim 4 wherein said wetting in step (d) is carried out by spreading water onto said layer and the amount of water supplied to said layer is controlled by monitoring quantities of supplied water and water lost from said layer.

7. The process defined in claim 4 wherein said layer is wetted in step (d) by guiding said layer into a water bath so that only a bottom portion of said layer is wetted and supplying water to said water bath in a metered quantity for wetting said bottom portion.

8. The process defined in claim 4, further comprising the step of applying to at least one zone of said top side of said layer a subatmospheric pressure.

9. The process defined in claim 4, further comprising the step of applying to at least one zone of said top side of said layer a superatmospheric pressure.

10. An apparatus for producing plasterboard, comprising:

means for mixing gypsum, fibers and water in an amount less than required for hardening of said gypsum to form a mixture;

at least one forming belt;

means juxtaposed with said belt and receiving said mixture for spreading said mixture in at least one layer on said belt;

means forming a preliminary press along said belt downstream of said means for spreading, for compressing said spread layer to 110 to 180% of a final thickness of said plasterboard;

means downstream of said means for spreading for successively applying water to upper and lower parts of a layer of said mixture precompressed on said belt and including upper and lower wetting devices;

a main press downstream of said preliminary press along said belt for pressing said layer after wetting of upper and lower parts thereof to a final plasterboard thickness;

an upper screen belt guided through said preliminary press and said lower wetting device;

a lower screen belt above said forming belt, said forming belt being returned downstream of said preliminary press and said lower screen belt extending at least through said lower wetting device.

11. The apparatus defined in claim 10 wherein said preliminary press has upper and lower pressure rollers spaced apart from one another and said upper wetting device includes spray nozzles arranged between said upper pressure rollers.

12. The apparatus defined in claim 10 wherein said lower wetting device includes a tray through which said layer is passed and guides for directing said screen belts through said tray, edges of said lower screen belt being turned upwardly and being water impermeable.

13. The apparatus defined in claim 12 wherein above said tray a box is provided for selectively applying fluid pressure to said layer, an underside of said box having a concave curved surface for guiding said layer into said tray.

14. The apparatus defined in claim 12, further comprising guide rollers above said tray forming a convex guide path in a travel direction for said layer.

15. The apparatus defined in claim 12 wherein said tray has a depth which is a multiple of said final thickness of said plasterboard.

* * * * *